US005094386A

United States Patent [19]

Tabacco

[11] Patent Number: 5,094,386

[45] Date of Patent: Mar. 10, 1992

[54] MAILBOX SIGNALS FLAG APPARATUS

[75] Inventor: Sebastian P. Tabacco, Fort Myers, Fla.

[73] Assignee: Josephine M. Tabacco, Ft. Myers, Fla.

[21] Appl. No.: 664,092

[22] Filed: Mar. 4, 1991

[51] Int. Cl.[5] ..... B65D 91/00

[52] U.S. Cl. ..... 232/35

[58] Field of Search ..... 232/35, 37, 34; 116/173, 174, 175

[56] References Cited

U.S. PATENT DOCUMENTS

| | | | |
|---|---|---|---|
| 3,207,427 | 9/1965 | Madewell | 232/35 |
| 3,338,511 | 8/1967 | Cvar | 232/35 |
| 3,391,861 | 7/1968 | Seckler | 232/35 |
| 3,596,631 | 8/1971 | Sutton | 232/35 |
| 3,620,443 | 11/1971 | Sturtz | 232/35 |
| 3,866,823 | 2/1975 | Grayson | 232/35 |
| 4,000,847 | 1/1977 | Duis | 232/35 |
| 4,138,056 | 2/1979 | Sherrill | 232/35 |
| 4,524,905 | 6/1985 | Crist | 232/35 |
| 4,702,411 | 10/1987 | Yager | 232/35 |
| 4,805,834 | 2/1989 | Saba | 232/35 X |

*Primary Examiner*—Gary L. Smith
*Assistant Examiner*—Michael J. Milano
*Attorney, Agent, or Firm*—William E. Noonan

[57] ABSTRACT

A signal flag apparatus is disclosed for use on a mailbox wherein a door operably connected to the mailbox is selectively closed and opened to permit and block access through a doorway to the interior of the mailbox. The apparatus includes a flag section having a pair of spaced-apart support post portions and a flag element that extends between the post portions. There are a pair of spaced-apart clip portions that detachably engage the mailbox proximate the doorway. There are also a pair of spring portions, each of which integrally interconnects a respective post portion and clip portion. The spring portions permit the flag section to be retracted within the mailbox and held therein by the door while the door is closed and urge the flag section to extend out of the mailbox when the door is subsequently opened to indicate that the door has been opened.

7 Claims, 3 Drawing Sheets

MAILBOX SIGNALS FLAG APPARATUS

FIELD OF THE INVENTION

This invention relates to a mailbox signal flag apparatus and, more particularly, to an apparatus for indicating when mail has been picked up from and/or delivered to a mailbox.

BACKGROUND OF THE INVENTION

A number of signal devices are available for indicating that mail has been delivered to and/or picked up from a conventional R.F.D.-type mailbox. Typically, these devices are attached to the mailbox by bolts, screws or other means that permanently mark or damage the box. Moreover, conventional mailbox signal devices employ a rather intricate, yet flimsy multi-part construction that is prone to breakage after repeated use. And, quite often, available mailbox signalling mechanisms are poorly visible, which renders them largely ineffective.

SUMMARY OF THE INVENTION

It is a therefore an object of this invention to provide a mailbox signal flag apparatus that is quickly, securely and removably mounted to a conventional mailbox without requiring extraneous clips, screws, bolts or other means that may permanently damage the box.

It is a further object of this invention to provide a mailbox signal flag apparatus that clearly and unmistakably indicates that mail has been delivered to and/or picked up from the mailbox. It is a further object of this invention to provide a mailbox signal flag apparatus that employs an improved, sturdy, and yet simplified one-piece spring construction that operates dependably over repeated uses.

This invention features a signal flag apparatus for use on a mailbox wherein a door operably connected to the mailbox is selectively opened and closed to respectively permit and block access through the doorway to the interior of the mailbox. The apparatus includes a flag section having a pair of spaced-apart support post portions and a flag element that extends between the post portions. There are a pair of spaced apart clip portions that detachably engage the mailbox proximate the doorway. There are also provided a pair of spring portions. Each spring portion integrally interconnects a respective post portion and clip portion. The spring portions permit the flag section to be retracted within the mailbox and held therein by the door while the door is closed. The spring portions also urge the flag section to extend out of the mailbox when the door is subsequently opened, thereby indicating that the door has been opened.

In a preferred embodiment, a connector portion integrally interconnects the support post portions. The post portions, clip portions, spring portions and connector portion may comprise an elongate, unitary wire element. The spring portions may include wire springs or alternatively may include coil springs. Preferably, the post portions are generally parallel and the flag element engages the connector portion.

DETAILED DESCRIPTION OF PREFERRED EMBODIMENT

Other objects, features and advantages will occur from the following description of a preferred embodiment and the accompanying drawings, in which.

Figure 1:
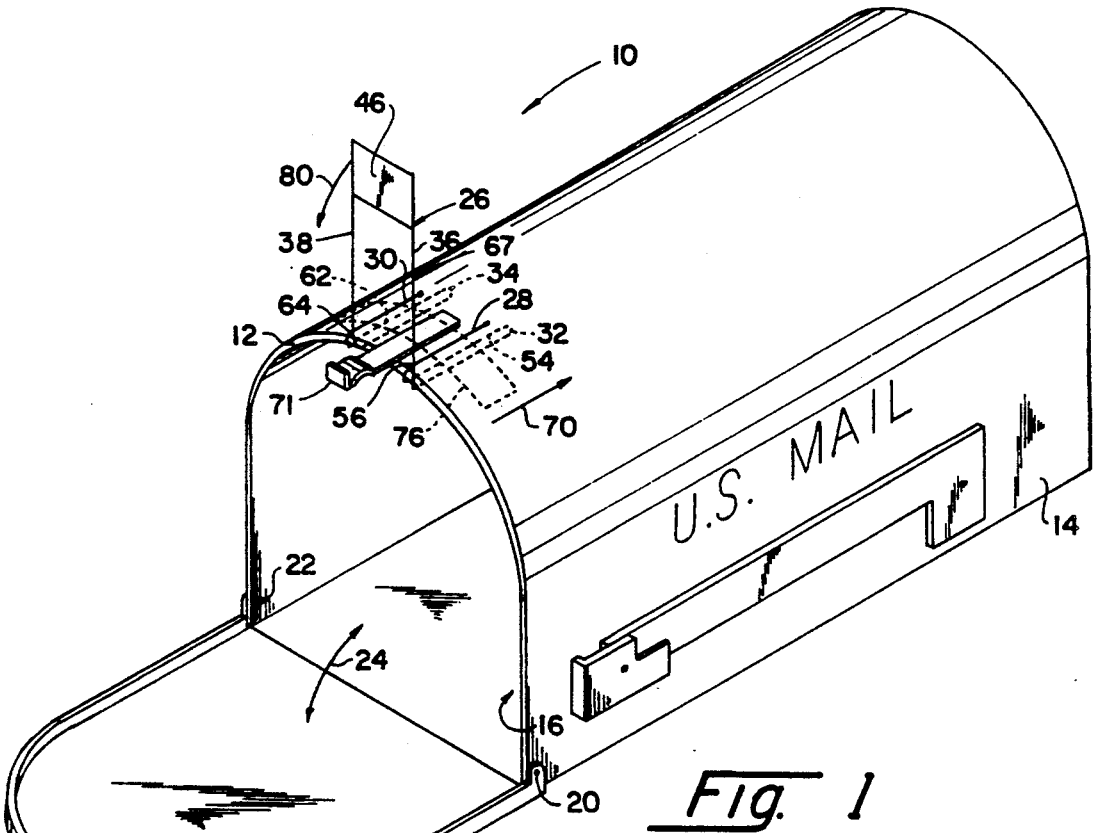
FIG. 1 is a perspective view of a signal flag apparatus, according to this invention, attached to a mailbox and in a deployed condition thereon.

There is shown in FIG. 1 a signal flag apparatus 10 that is attached to a conventional R.F.D. mailbox 14 for indicating that mail has been delivered to or picked up from the box. In particular, apparatus 10 engages a forward edge 12 that defines an entrance or doorway 16 of mailbox 14. A door 18 having a shape that complements that of doorway 16 is hingedly attached to mailbox 14 by pivots 20 and 22. Door 18 is pivoted, as indicated by double-headed arrows 24, to selectively open and close the mailbox. When the door is opened, mail may be delivered to and retrieved from the box in a conventional manner.

Figure 2:
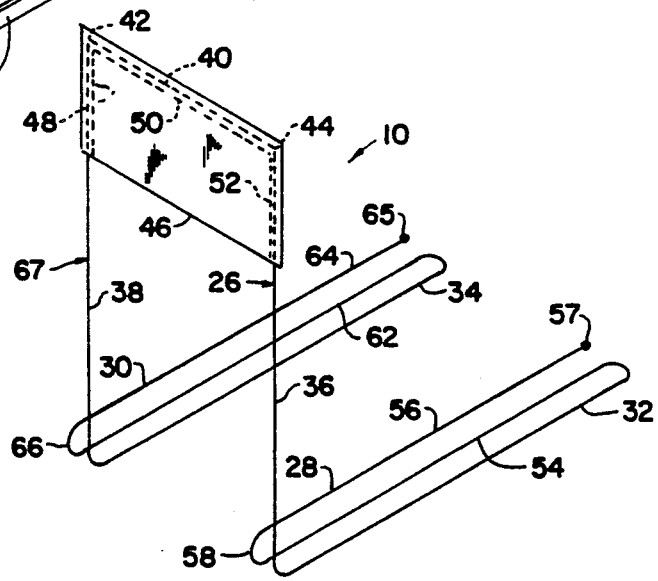
FIG. 2 is a perspective view of the signal flag apparatus.

Signal flag apparatus 10, shown alone in FIG. 2, includes a flag section 26, a pair of serpentine clip portions 28 and 30 that detachably engage mailbox 14, and a pair of spring portions 32 and 34, which interconnect clip portions 28 and 30, respectively, with flag section 26.

More particularly, flag section 26 includes a pair of support posts 36 and 38 that are integrally connected by a connector portion 40. Support posts 36 and 38 and connector portion 40 are typically formed by a resilient wire element, such as wire spring, piano wire or similar item. This wire element is bent at 90 degree angles, such as at points 42 and 44, so that the support posts 36 and 38 are generally parallel and connector portion 40 is formed between the posts. A signal flag element 46 extends between support posts 36 and 38 and engages connector portion 40. Flag element 46 preferably comprises a sturdy, yet lightweight material such as a thin piece of tape, fabric or aluminum. Edges 48, 50 and 52 of element 46 are folded over support post 36, connector section 40 and support post 38, respectively, so that the flag element is attached to the wire support post and connector portion. The flag element preferably includes a bright, plainly visible color, such as orange or red and may be fluorescent to further improve visibility. A preferred size for the flag element is 2" wide $\times$ 1 ½" high, although these dimensions are for illustrative purposes only and are not a limitation of the invention.

Each of clip portions 28 and 30 includes a piece of resilient wire material. More particularly, clip portion 28 includes an inside segment 54 and an outside segment 56 that is integrally attached to and extends from segment 54. As best shown in FIG. 1, segment 54 engages the inside surface of mailbox 14 and segment 56 engages the outside surface of the mailbox. Clip portion 28 also includes an integral spring segment 58 that urges the distal end 57 of segment 56 toward segment 54. As a result, segments 54 and 56 are urged against the inside and outside mailbox surfaces, respectively, so that clip portion 28 securely engages the box. Similarly, clip portion 30 includes an inside segment 62 and an outside segment 64. The distal end 65 of segment 64 is urged toward loop 62 by an integral spring segment 66 in clip portion 30. As a result, clip portion 30 engages the mailbox in a manner similar to clip portion 28. The length of the clip segments may be varied to accommodate differing sizes of mailboxes.

Spring portion 32 comprises a resilient wire segment that integrally interconnects support post 36 with segment 54 of clip portion 28. Similarly, spring portion 34 includes a resilient wire segment that integrally interconnects support post 38 with segment 62 of clip portion 30. Spring portions 32 and 34 bias flag section 26 into the deployed, extended condition shown in FIGS. 1 and 2.

Clip portion 28, spring portion 32, support post 36, connector portion 40, support post 38, spring portion 34 and clip portion 30 define a unitary resilient wire element 67. This element is preferably formed of a sturdy tempered metallic wire, such as piano wire that is formed into the configuration shown in FIGS. 1 and 2. By employing such a single-piece construction, manufacturing difficulties and expenses are minimized. Additionally, the operation of the apparatus is simplified considerably. In alternative embodiments, resilient plastics and other materials may be employed to form element 67.

Apparatus 10 is removably attached to mailbox 14 by spreading distal ends 57 and 65 of clip segments 56 and 64 apart from segments 54 and 62, respectively. Apparatus 10 is then slipped, in the direction of arrow 70, FIG. 1, onto mailbox 14 over edge 12, such that the wall of the mailbox is inserted between segments 54 and 56 of clip portion 20 and between segments 62 and 64 of clip portion 30. The spring portions 58 and 66 urge clip portions 28 and 30, respectively, to securely engage the wall of mailbox 14 so that device 10 is attached to the mailbox such that it straddles door latch 71. To improve the adherence of the signal apparatus to mailbox 14, a piece of tape or similar adhesive 76, shown in phantom, may be applied over the clip segments 56 and 64 that engage the outer surface of the mailbox.

Figure 3:
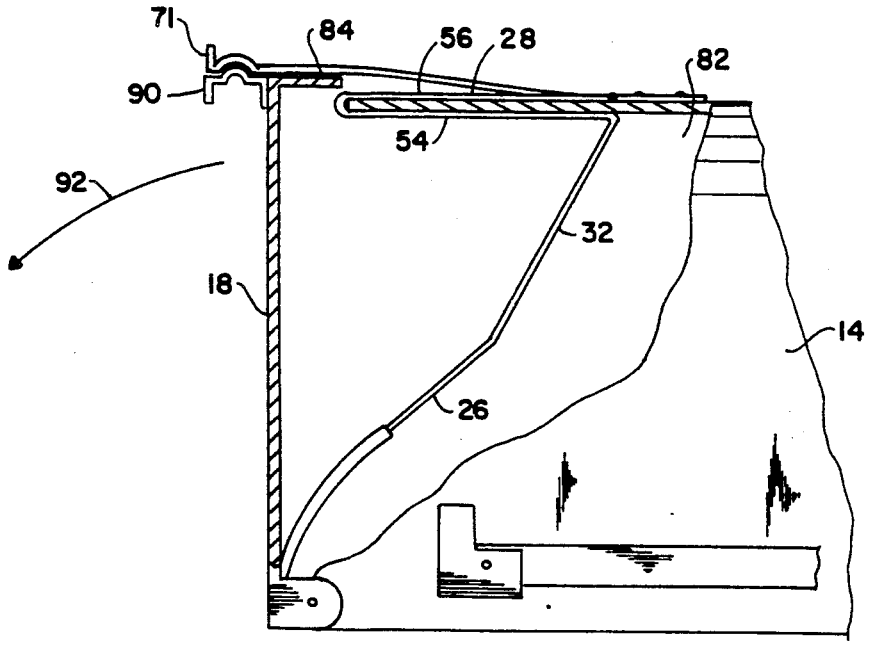
FIG. 3 is an elevational, partly cut-away side view of the signal apparatus retracted within a closed mailbox.

Apparatus 10 is operated in the following manner. Before the mail carrier arrives, the signal apparatus is set by pulling flag section 26 downwardly in the direction of arrow 80, FIG. 1. Spring portions 32 and 34 permit flag section 26 to bend from the position shown in FIG. 1, wherein flag element 46 is deployed above mailbox 14, to the position shown in FIG. 3, wherein the flag section 26 is retracted into compartment 82 of mailbox 14. In this position, flag section 26 extends generally downwardly within the mailbox. Segment 56 of clip portion 28 remains engaged with the outside surface of the mailbox and segment 54 remains engaged with the inside surface of the box. Clip portion 30, which is obscured in FIG. 3, remains similarly attached to the mailbox. After flag section 26 is retracted in this manner, door 18 is closed such that door handle 90 engages latch 71 and the peripheral lip 84 of the door snap fits onto the mailbox 14. More particularly, lip 84 engages each of the clip portions 28 and 30 (not shown). Closed door 18 holds flag section 16 inside mailbox 14. This indicates to the owner of the mailbox that the box has not been opened by the mail carrier.

Figure 4:
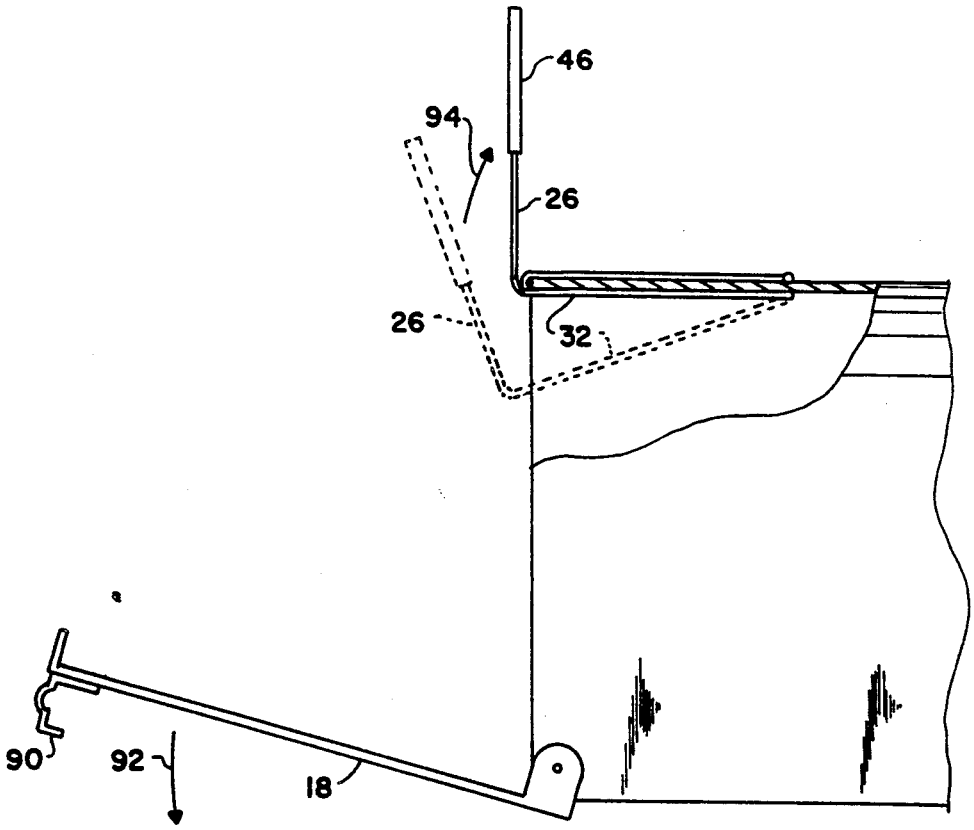
FIG. 4 is a view similar to FIG. 3 of the signal apparatus in the deployed condition following opening of the mailbox.

The carrier delivers mail to and/or collects mail from mailbox 14 by grasping door handle 90 and opening door 18 in the direction of arrow 92. As shown in FIG. 4, when the door is opened, spring portions 32 and 34 (not shown), urge flag section 26 to spring outwardly from the mailbox in the direction of arrow 94. As a result, flag section 26 is deployed to extend in a generally vertically upward direction, as further illustrated in FIGS. 1 and 2. This indicates to the owner of the mailbox that door 18 had been opened, such as for the collection and/or delivery of mail. The owner of the box may then go to the box at his or her convenience to pick up mail that has been delivered and reset apparatus 10 to the position shown in FIG. 3. Resetting the apparatus is accomplished by again retracting flag section 26 downwardly in the direction of arrow 80 and re-closing door 18, As a result, apparatus 10 is ready for subsequent operation in response to the next mail delivery and/or pickup. During both retraction and deployment of flag section 26, the clip portions 28 and 30 remain securely fastened to mailbox 14.

Figure 5:
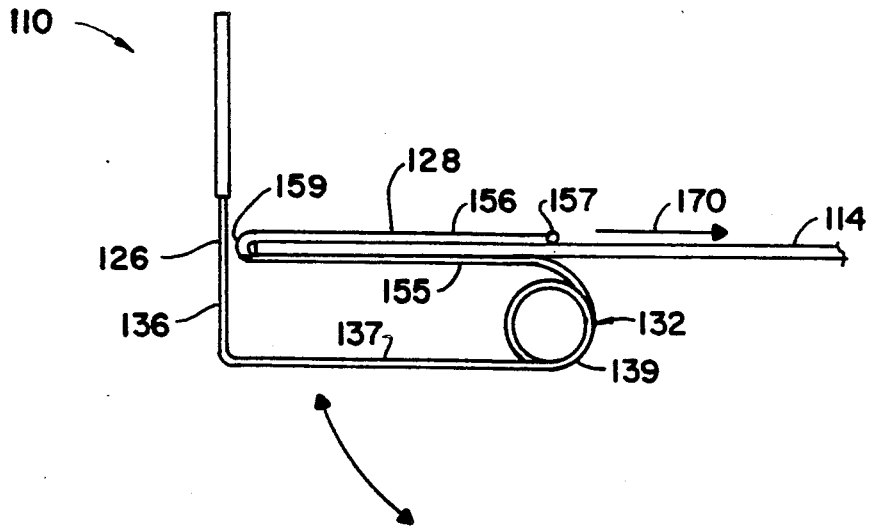
FIG. 5 is an elevational side view of an alternative signal apparatus that employs coil springs for retracting and extending the signal flag.

An alternative signal flag apparatus 110 is shown in FIG. 5. Therein, a flag section 126 includes a pair of post sections 136, only one of which is shown, for supporting a flag element 146. These support posts are joined by a connector portion (not shown), as previously described. Each of the post sections is attached by a respective spring portion 132 comprising a generally horizontal segment 137 and an integral coil spring 132. Each coil spring is integrally attached to a respective clip portion 128 that includes an inside segment 155 for engaging the inside surface of the mailbox 14 and an outside segment 156 for engaging the outside surface of the mailbox. The distal end 157 of segment 156 is urged toward segment 155 by a spring segment 159 so that each clip portion 128 is securely attached to box 114. Although only a single post 136, spring portion 132 and clip portion 128 are shown in FIG. 5, it should be understood that pairs of such elements are utilized in a manner analogous to the embodiment shown in FIGS. 1–4. The clip portions 128, spring portions 132, support posts 136, and the connector portion are formed by a unitary wire element.

To mount apparatus 110 to mailbox 114, each clip segment 156 is spread apart from its associated clip segment 155 and the clip portions 128 are slid, in the direction of arrow 170, onto the wall of mailbox 114. Because the clip segments 156 are urged toward the clip segments 155, the clip portions 128 remain securely engaged to the wall of the mailbox. Spring portions 132 bias flag section 126 into a deployed condition outside of the mailbox. To set the apparatus 110 for use, flag section 126 is urged downwardly, as previously described. Spring portions 132 allow the flag section 126 to be pulled into the mailbox 114 and the flag section is held in the mailbox by the closed door of the box. When the carrier arrives to deliver or pick up mail he opens the door and spring portions 132 urge flag section 126 out through the doorway into the position shown in FIG. 5. This indicates to the box owner that mail has been picked up and/or delivered.

Figure 6:
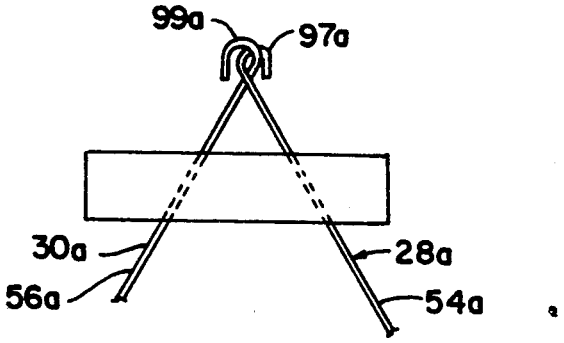
FIG. 6 is a partial perspective view of a pair of interengaging outer clip elements.

As shown in FIG. 6, clip portions **28*a* and 30*a* may include respective outside segments 56*a*, 54*a* that include hooks 97*a* and 99*a*** formed at the distal ends thereof. These hooked ends interlock so that the signal apparatus is centralized on the mailbox.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A signal flag apparatus for use on a mailbox wherein a door, operably connected to the mailbox, is selectively opened and closed to permit and block access through a doorway to the interior of the mailbox, said apparatus comprising:

a flag section that includes a pair of spaced-apart support port portions, a connector portion that integrally interconnects said support post portions and a flag element that extends between said support post portions;

a pair of spaced-apart clip portions that detachably engage the mailbox proximate said doorway; and a pair of spring portions, each integrally interconnecting a respective support post portion and clip portion, said spring portions permitting said flag section to be retracted within said mailbox and held therein by said door while said door is closed and urging said flag section to extent out of said mailbox when said door is subsequently opened to indicate that said door has been opened.

2. The apparatus of claim 1 in which said support post portions, clip portions, spring portions and connector portion define an elongate unitary element.

3. The apparatus of claim 1 in which said spring portions include wire springs.

4. The apparatus of claim 1 in which said spring portions include coil springs.

5. The apparatus of claim 1 in which said support post portions are generally parallel.

6. The apparatus of claim 1 in which said flag element engages said connector portion.

7. A signal flag apparatus for use on a mailbox wherein a door, operably connected to the mailbox, is selectively closed and opened to permit and block access through a doorway to the interior of the mailbox, said apparatus comprising:

a flag section that includes a pair of spaced-apart support post portions, a connector portion that integrally interconnects said post portions and a flag element that extends between said support post portions and said connector portion;

a pair of spaced-apart clip portions that detachably engage the mailbox proximate said doorway; and a pair of spring portions, each integrally interconnecting a respective support post portion and clip portion, said spring portions permitting said flag section to be retracted within said mailbox and held therein by said door while said door is closed and urging said flag section to extend out of said mailbox when said door is subsequently opened to indicate that said door has been opened.

* * * * *